US005479800A

United States Patent [19]

Myers

[11] Patent Number: 5,479,800

[45] Date of Patent: Jan. 2, 1996

[54] PLASTIC LOCK

[75] Inventor: Gary L. Myers, River Grove, Ill.

[73] Assignee: Fort Lock Corporation, River Grove, Ill.

[21] Appl. No.: 102,642

[22] Filed: Aug. 5, 1993

Related U.S. Application Data

[63] Continuation-in-part of Ser. No. 962,855, Oct. 19, 1992, abandoned.

[51] Int. Cl.[6] ..... E05B 29/00

[52] U.S. Cl. ..... 70/365; 70/367; 70/370; 70/DIG. 30

[58] Field of Search ..... 70/DIG. 30, DIG. 46, 70/365, 367, 370–372, 379 R, 380, 451, 460

[56] References Cited

U.S. PATENT DOCUMENTS

| | | | |
|---|---|---|---|
| 1,564,883 | 12/1925 | Muzzio | 7/365 |
| 1,747,383 | 2/1930 | Norviel | 70/DIG. 30 X |
| 2,680,368 | 6/1954 | McKitrick | 70/DIG. 30 X |
| 3,385,086 | 5/1968 | Patriquin | 70/460 X |
| 3,465,557 | 9/1969 | Ryder | 70/367 X |
| 3,660,624 | 5/1972 | Bell | 70/DIG 46 X |
| 4,305,267 | 12/1981 | Nish et al. | 70/460 X |
| 4,550,580 | 11/1985 | Neyret | 70/451 X |
| 4,558,193 | 12/1985 | Test | 70/DIG. 30 X |
| 4,829,798 | 5/1989 | Roop | 70/380 X |
| 4,910,982 | 3/1990 | Dana | 70/370 |

FOREIGN PATENT DOCUMENTS

| | | | |
|---|---|---|---|
| 230484 | 8/1987 | European Pat. Off. | 70/460 |
| 1019379 | 1/1953 | France | 70/365 |
| 2420272 | 12/1974 | Germany | 70/365 |
| 3503660 | 8/1986 | Germany | 70/365 |
| 402646 | 5/1966 | Switzerland | 70/460 |
| 236625 | 7/1925 | United Kingdom | 70/365 |

*Primary Examiner*—Peter M. Cuomo
*Assistant Examiner*—Suzanne L. Dino
*Attorney, Agent, or Firm*—Leydig, Voit & Mayer

[57] ABSTRACT

A key lock mechanism which can be made entirely of molded plastic parts having (1) a lock shell that can be snap fit in a mounting opening, wherein the shell is a predominantly cylindrical casing having a front end, a rear end, and an interior longitudinal channel; and (2) a lock plug, having a front end and a rear end, longitudinally housed within and rotatable about the longitudinal axis of the shell. The front end of the lock plug has a keyway allowing the insertion of a key to operate a double-acting, bar tumbler having a rocker body with a front peg and rear peg; an integral axle perpendicular to and connecting the center rocker body to a left and a right pivot pad upon which the bar tumbler pivots. The insertion of the key pivots the bar tumbler within the longitudinal shell channel and enables the key to turn the plug within the shell to operate the lock. The rear end of the plug receives a snap on actuation means such as a cam. Another embodiment of the invention is a plastic switch lock which combines the same tumbler means with a rotatable, electrically conductive contact within the plug effective for electrically communicating with a least two electrically conductive terminals.

14 Claims, 3 Drawing Sheets

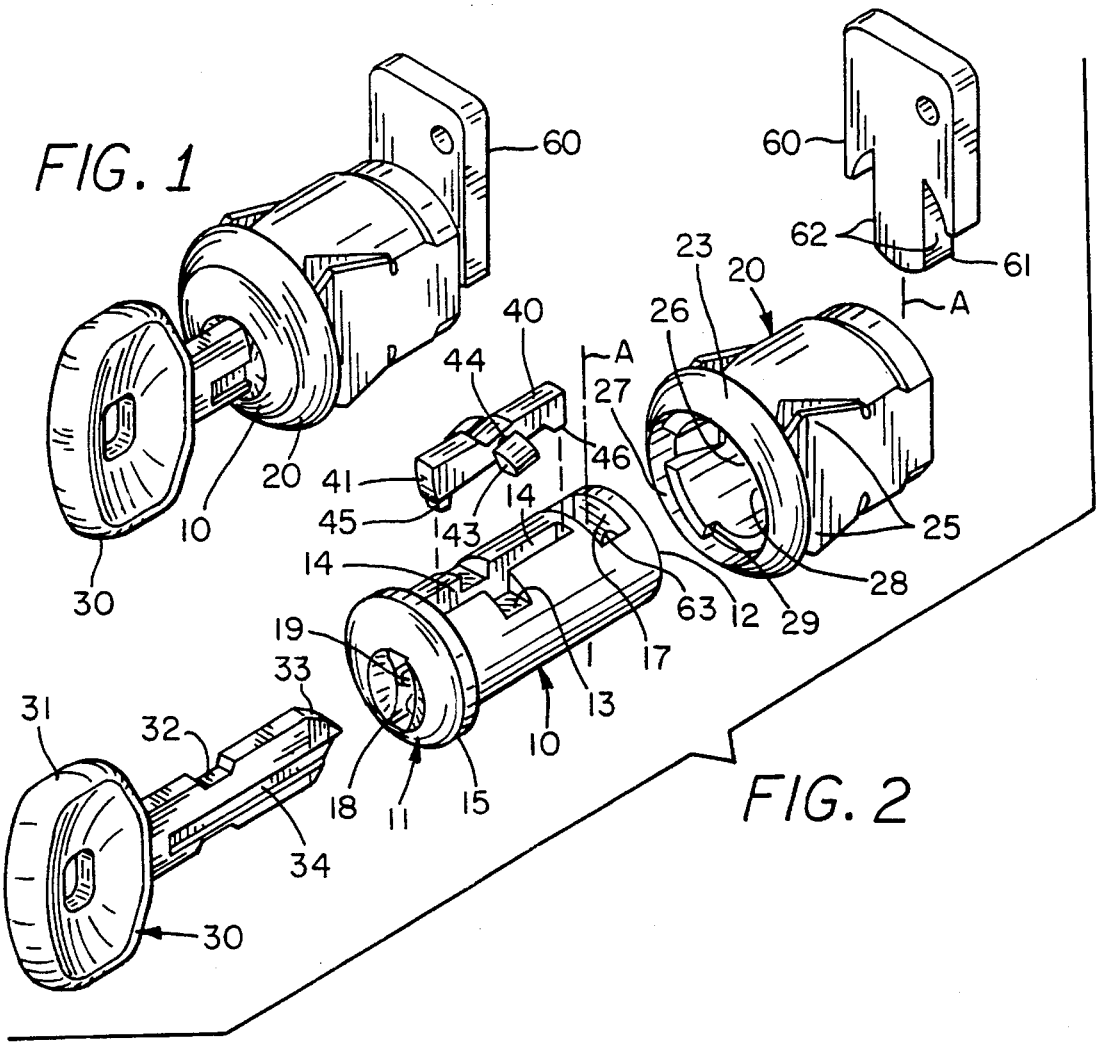
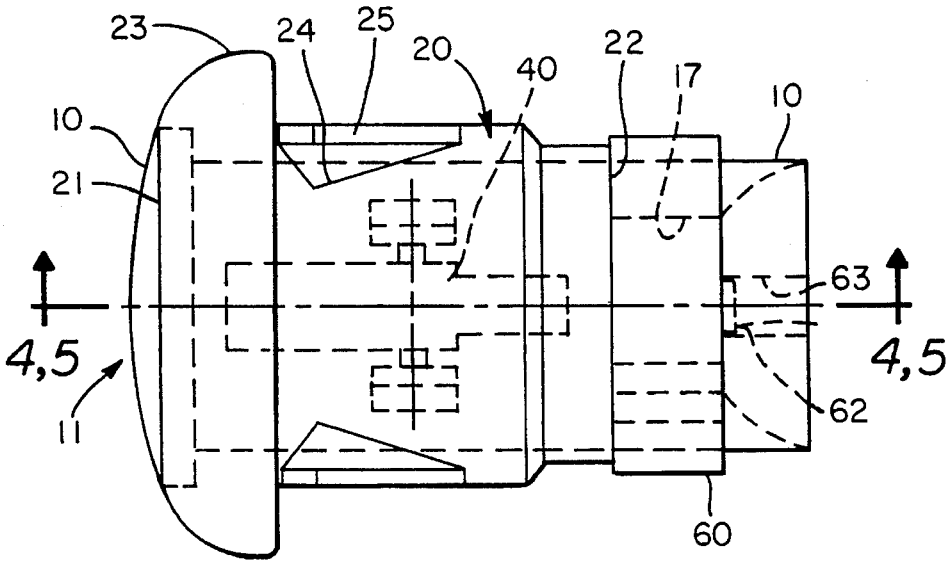
FIG. 3

PLASTIC LOCK

RELATED APPLICATIONS

This application is a continuation-in-part of my application Ser. No. 07/962,855 filed Oct. 19, 1992 and abandoned.

FIELD OF THE INVENTION

The present invention relates generally to plastic locks, and more particularly, to an improved and simplified construction for plastic locks which allows for numerous keying combinations, easy assembly and mounting at low cost.

BACKGROUND OF THE INVENTION

The present field of locks primarily encompasses metal locks with springs and tumblers which involve intricate design and considerable complexity. This complexity results in manufacturing difficulties, greater expense, and time consumption in assembly and mounting. Metal locks are also prone to environmental degradation (i.e., rust and corrosion) in certain hostile conditions. The use of metal locks and keys in magnetically and electrically conductive environments is also disfavored in certain applications.

Recently, in certain applications such as, for example, tape storage files having drawers or panel doors, a demand has arisen for plastic locks to go along with the plastic structures of such files. However, available plastic locks have not provided the desired level of security, ease of assembly and mounting sought by users. An example of such a lock is shown in U.S. Pat. No. 4,910,982.

As a result of the shortcomings and problems related to the presently available plastic locks, there is a substantial need for a lock which provides a certain level of security at low cost and with ease of assembly and mounting in numerous environments.

OBJECTS OF THE INVENTION

It is therefore the general aim of the present invention to provide a low cost, easily manufactured, assembled and mounted plastic lock providing a relative degree of security suitable to a number of different applications and environments.

Another object of this invention is to provide a fully plastic construction for the lock components and the key which readily permits differing combinations at low cost.

Another object is to provide a lock assembly of the foregoing type that accommodates multiple mounting wall thicknesses and may be "snapped" into place without auxiliary retaining devices and insertable from the front of a mounting surface.

SUMMARY OF THE INVENTION

These and other objects of this invention are realized by providing a three component plastic lock which includes a lock shell, a lock plug within the central opening of the lock shell, and a key-actuated bar tumbler capable of dual action. The lock shell includes provision for easy snap-in mounting. A preferably double-bitted key, which may also be made of molded plastic, is inserted into the front end of the lock plug. The front end of the key engages and pivots the bar tumbler from its normal position into a raised position until the key is fully inserted into the lock enabling the front peg on the bar tumbler to seat within the notch cut in the key. With the front peg of the bar tumbler seated in the key notch, the plug is able to rotate within the shell for proper lock operation. Also, by changing the position of the notch and the bar tumbler length accordingly, numerous keying combinations are possible. The rear end of the plug extends beyond the cylindrical shell and is designed to have an actuation means attached to it that also rotates with the lock plug.

The invention and other features and advantages thereof will be more readily apparent upon reading the following description of a preferred embodiment of the invention when taken in conjunction with the accompanying drawings.

BRIEF DESCRIPTION OF THE DRAWINGS

FIG. 1 is a perspective view of one embodiment of the lock mechanism of the present invention.

FIG. 2 is an exploded view of the lock mechanism and its component parts.

FIG. 3 is a top view of the lock mechanism.

DETAILED DESCRIPTION OF THE PREFERRED EMBODIMENT

Figure 4:
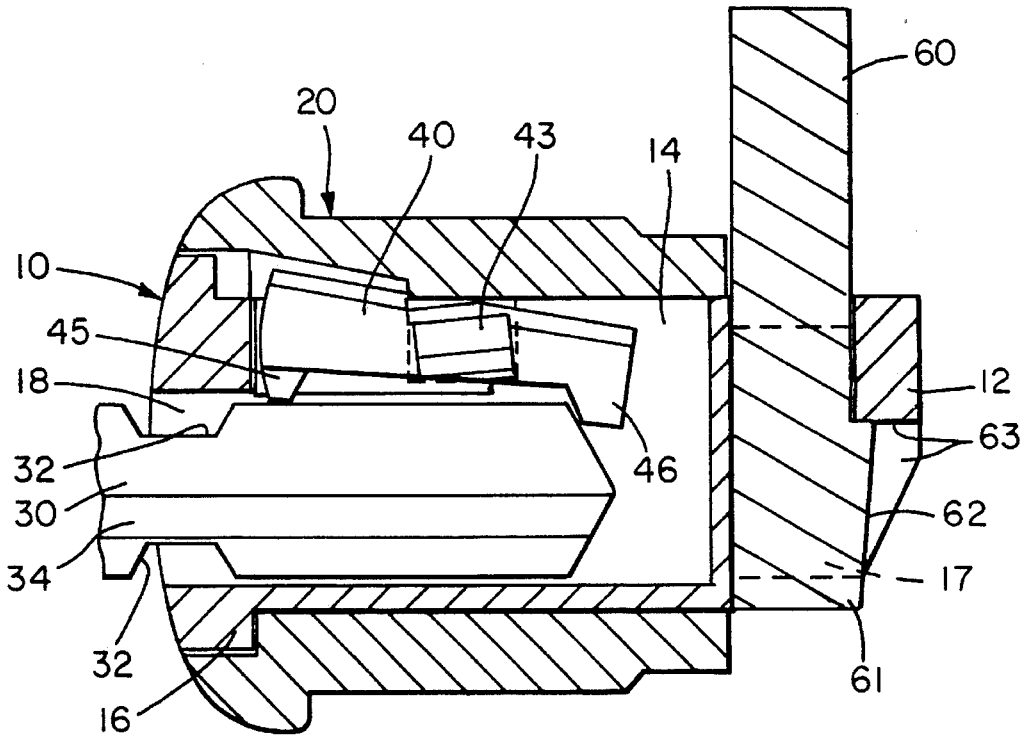
FIG. 4 is a side-sectional view of the lock mechanism with the key partially inserted.

While the invention will be described and disclosed in connection with certain preferred embodiments and procedures, it is not intended to limit the invention to those specific embodiments. Rather it is intended to cover all such alternative embodiments and modifications that fall within the spirit and scope of the invention.

Turning now to the drawings, FIG. 1 shows one exemplary embodiment of the lock mechanism according to the present invention. The lock mechanism is shown in its fully assembled state. A lock plug 10 fits within a shell 20. When installed, the shell 20 fits in a circular hole in the panel door or drawer to be secured, as will be described below. The assembled lock mechanism also includes an actuation means in the form of a cam 60 attached to the lock plug 10. A key 30 is received in the lock plug 10 for operation of the lock mechanism.

FIG. 2 shows an exploded view of the lock mechanism with the component parts. As will be described further below, the key 30 is inserted into keyway 18 in the front end 11 of the lock plug 10 until it actuates the tumbler 40. Once the tumbler 40 is properly actuated, the plug 10 and cam 60 may be rotated by the key 30 to operate the invention. The tab 61 of the cam 60 fits into the actuation receiving means A in the plug. The securing ramp 62 of the cam 60 snaps into the securing notch 63. The cam 60 performs at least two functions: latching the door closed and securing the plug 10 within the shell 20.

The plug component of the lock is shown in FIG. 2. The plug 10 comprises: a front end 11, a rear end 12, a pivot pad recess 13, a rocker body recess 14, a facing flange 15, a rotational tab 16, an actuation receiving means 17, and a keyway 18, having one or more keyway lugs 19.

The shell component of the lock is also shown in FIG. 2. The shell 20 comprises: a front end 21, a rear end 22, a facing lip 23, a mounting flange recess 24, a mounting flange 25, and a throughbore 26.

The throughbore 26 of the shell 20 accommodates the plug 10 through the front end 21. The plug 10 passes through the shell 20, with the actuation means 17 extending beyond the rear end 22 of the shell 20. Since the diameter of the facing lip 23 is larger than the mounting hole (not shown), the facing lip 23 prevents the lock shell 20 from passing through the mounting hole in which the lock is installed. The mounting flanges 25 on the outer portion of the shell 20 are used to secure the lock in the mounting hole. The entire assembly is inserted into the mounting hole until the mounting flanges 25 contact the mounting hole. As the lock assembly is pressed into the hole, the resilient mounting flanges 25 bend over into the mounting flange recesses 24. When the lock assembly is fully inserted into the mounting hole, the mounting flanges 25 spring back into place and are pressed against the inner side of the mounting hole wall, thus holding the lock assembly in place. The facing lip 23 then butts up flush against the outer side of the wall in which the lock is installed. The design of the mounting flanges 25 allows them to accommodate different wall thicknesses.

The bar tumbler 40 of the present invention comprises: a rocker body 47 having a front end 41 with a front peg 45, a rear end 42 with a rear peg 46, and two pivot pads 43 integrally mounted on an axle 44 which is perpendicularly oriented and integrally connected to the rocker body 47 of the bar tumbler 40. The bar tumbler 40 length dimensions may be varied to correspond with different keys to provide for a multitude of key 30 and bar tumbler 40 combinations.

The pivot pads 43 of the bar tumbler 40 are seated in the pivot pad recesses 13 of the plug 10. When the bar tumbler 40 is actuated, it pivots on the pivot pads 43 and the center rocker body 47 is disposed within the rocker body recess 14. When the bar tumbler is actuated, the plug 10 can be rotated within the shell 20, but only a limited amount. When the lock is assembled, the facing flange 15 fits within the rotational channel 27. During operation of the invention, the facing flange 15 of the plug 10 rotates within the rotational channel 27 between an arc limited by the upper stop 28 and the lower stop 29 of the rotational channel 27.

The key component of the lock is depicted in FIG. 2. The preferred embodiment comprises a double-bitted key 30 having a head 31, a front end 33, one or more wards 34, and one or more notches 32. The double-bitted design allows for the key 30 to be used normally or upside-down. The length dimension as measured approximately from the front end 33 to the notch 32 may be varied on different keys to provide for a multitude of key and tumbler combinations. The dimensions and location of the wards 34 on the key 30 may also be varied to increase the number of different key combinations available.

Figure 5:
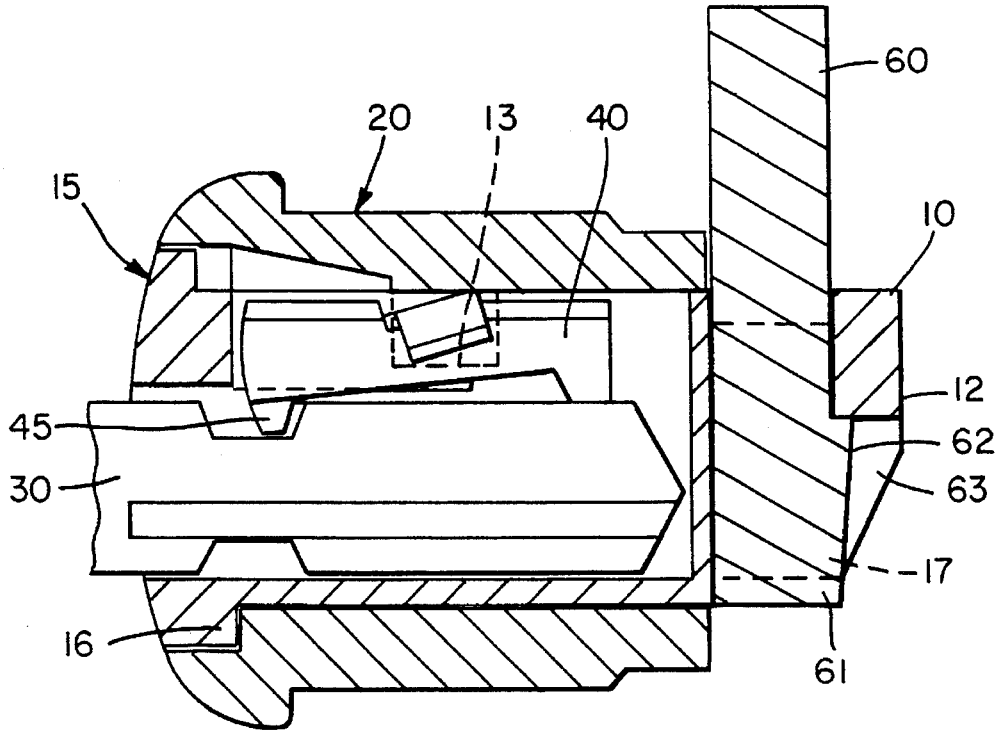
FIG. 5 is a side-sectional view of the lock mechanism with the key fully inserted.

As can be seen from FIG. 3, FIGS. 4 and 5 are sectional, longitudinal views. The operation of the lock mechanism will now be described with reference to FIGS. 4 and 5. FIG. 4 shows a preferred embodiment of the present invention with a key 30 partially inserted into the keyway 18 of the plug 10 which is housed within the shell 20. The insertion force supplied by a user is translated to the front end of the key 30 which impinges upon the rear peg 46 of the bar tumbler 40 which causes the bar tumbler 40 to pivot on the pivot pads 43 about an axis of rotation that is coincident with the axis of the axle 44. This impinging motion forces the rear peg 46 and the rear end of the bar tumbler 40 upward and the front peg 45 and the front end of the bar tumbler 40 downward against the key 30. Further insertion of the key 30 into the keyway 18 eventually leads to the position depicted in FIG. 5.

FIG. 5 shows a key 30 fully inserted into the keyway 18 of the plug 10 which is housed within the shell 20. At this point, the front peg 45 of the bar tumbler 40 has been forced down and is seated in the notch 32 of the key 30. With the front peg 45 seated in the notch 32, the bar tumbler 40 rests approximately horizontally within the plug 10. When the bar tumbler 40 is in this position, the user turns the key 30 to rotate the plug 10 within the shell 20 which also rotates the cam 60.

Figure 6:
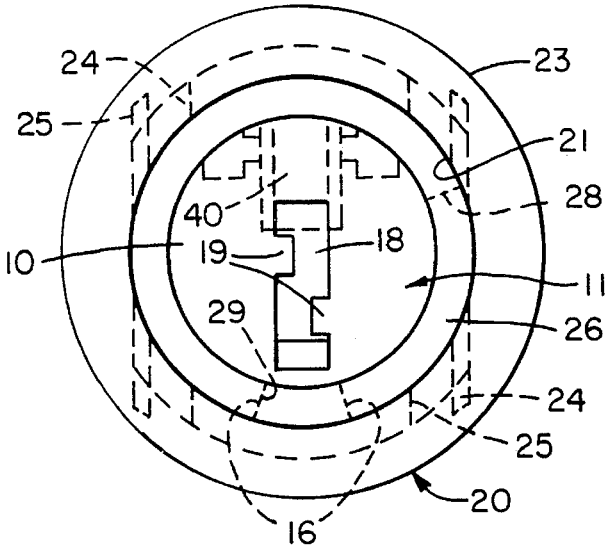
FIG. 6 is a front view of the lock mechanism.

FIG. 6 is a front view of the lock mechanism with the key 30 removed. FIG. 6 clearly shows the positional relationship of the bar tumbler 40 with respect to the keyway 18. Insertion of the key 30 into the keyway 18 will cause actuation of the bar tumbler 40. FIG. 6 also shows the resilient mounting flanges 25 in the extended position so as to hold the lock mechanism in place within the mounting hole.

Figure 7:
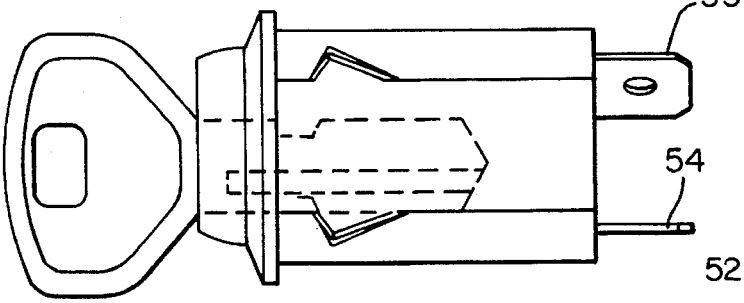
FIG. 7 is a side view of a second embodiment of the lock mechanism according to the invention.
Figure 8:
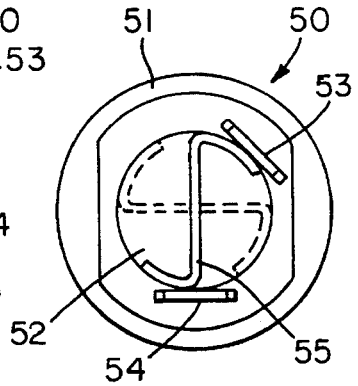
FIG. 8 is a rear view of the second embodiment of the lock mechanism.

Another embodiment of the present invention is a plastic switch lock 50 as shown in FIGS. 7 and 8. The plastic switch lock 50 comprises a plastic shell 51 and plug 52. The plastic plug 52 further comprises an electrically conductive S-shaped contact 55 which can rotatably contact an upper electrically conductive terminal 53 and a lower electrically conductive terminal 54 to close an electrical circuit. As the bar tumbler operates in the same manner as disclosed above, the rotation of the key 30 within the plug 10 causes the contact 55 to rotate from a position of simultaneous electrical contact with both the upper terminal 53 and the lower terminal 54 as shown in solid lines in FIG. 8 to a position in which the contact 55 is contacting only one or none of the terminals 53, 54 as shown in phantom. Of course, the reverse rotation of the contact 55 is also possible, e.g. from the single or no contact position to the simultaneous contact position. Such a configuration of the contact 55 and terminals 53, 54 is useful in situations where only a small amount of current will flow across contact 55.

Figure 9:
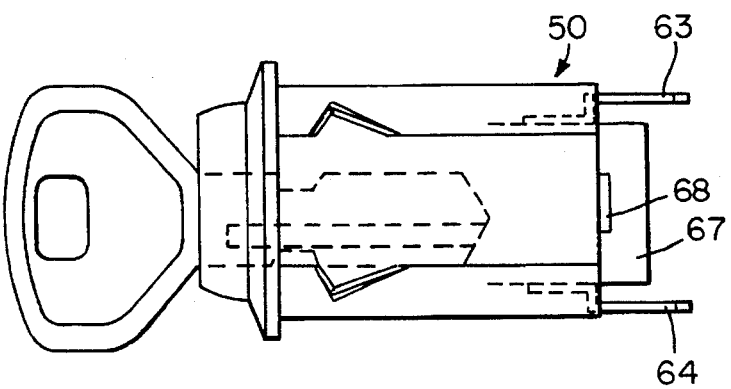
FIG. 9 is a side view of a third embodiment of the lock mechanism according to the invention.
Figure 10:
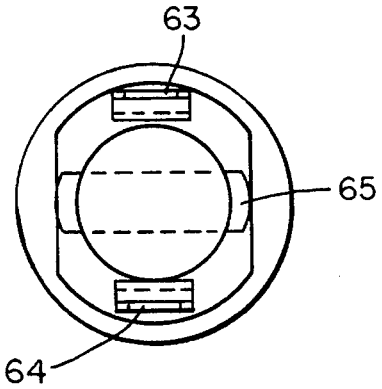
FIG. 10 is a rear view of the third embodiment of the lock mechanism.

A further alternative embodiment of plastic switch lock 50 is shown in FIGS. 9 and 10. This embodiment includes two electrically conductive terminals 63 and 64 which are diametrically opposed on the lock shell. Also included is an electrically conductive rotating cam 65. Rotating cam 65 can move between a position where it is out of contact with both contacts 63 and 64, as shown in FIG. 10, and a position where it contacts both terminals 63 and 64 to close an electrical circuit. This rotating cam is straight, as opposed to S-shaped, and has a greater thickness than in the previous embodiment. Its straight shape necessitates the arrangement of the contacts. The greater thickness of contact 65 allows this embodiment to be used in higher current requirement situations. To secure the electrically conductive contact 65 to the lock plug 52 for rotation therewith, lock plug 52 includes a contact retaining extension 67, shown in FIG. 9. Contact retaining extension 67 is a rectangular solid extending rearwardly from lock plug 52 that includes a radial slot 68 that is sized to receive electrically conductive contact 65. Thus, the plastic switch lock 50 enables simple electrical switch closures in a secure, cost-effective manner.

It will be appreciated by those skilled in the art that the present lock configuration, together with the keys can be made of molded plastic such as ABS material and coloration schemes can be employed to coordinate with the structure receiving the lock or for coding purposes.

I claim as my invention:

1. A key lock mechanism, comprising:

a lock shell, wherein said shell comprises a predominantly cylindrical casing having a front end, a rear end, a central throughbore having at least one interior longitudinal channel;

a lock plug, having a front end and a rear end, longitudinally disposed and rotatable about a longitudinal axis within the central throughbore of the lock shell, the lock plug including a longitudinal recess and pivot pad recesses disposed perpendicularly to and on opposing sides of the longitudinal recess, the lock plug further comprising:

a double-acting, key-actuated tumbler means comprising a bar tumbler having a center rocker body receivable within the longitudinal recess and having a top and a bottom wherein said bottom comprises a front peg and rear peg, said bar tumbler including an integral axle perpendicular to and extending laterally beyond said center rocker body, said axle connecting said center rocker body to a left and a right pivot pad, said pivot pads each including a flat, angled bottom surface, and being receivable in one of the pivot pad recesses, the angled bottom surfaces of the pivot pads engaging the respective pivot pad recesses for gravitationally biasing said tumbler means to a locking position where said top engages said interior longitudinal channel; and a keyway in the front end of the lock plug allowing insertion of a key into the key-actuated tumbler means such that both front and rear pegs of the tumbler means are actuated thereby disengaging the tumbler means top from the interior longitudinal channel and enabling the lock plug to be rotated within the throughbore.

2. A lock mechanism as claimed in claim 1, and further including an actuation means and wherein said lock plug further includes an actuation receiving means at its rear end.

3. A lock mechanism as claimed in claim 1, wherein the interior longitudinal channel in the throughbore is configured such that a properly bitted key is required for the actuation of the key-operated tumbler means and to rotate the lock plug.

4. A lock mechanism as claimed in claim 1, wherein the lock plug includes a rotational stop to restrict the rotation of the lock plug within the lock shell.

5. A lock mechanism as claimed in claim 2, wherein the actuation receiving means is adapted to receive a snap fit cam.

6. A lock mechanism as claimed in claim 2, wherein the actuation means is an electrical switch.

7. A lock mechanism as claimed in claim 6 wherein said switch further comprises a first electrically conductive terminal and a second electrically conductive terminal attached to said shell, and an integral electrically conductive contact coupled to said actuation receiving means for rotation with said lock plug and effective for simultaneously communicating electrically with said first terminal and said second terminal upon rotation of the lock plug.

8. A lock mechanism as claimed in claim 1, wherein said lock mechanism comprises all molded parts of plastic.

9. A lock mechanism as claimed in claim 8, wherein the key and the lock are color-coordinated.

10. A lock mechanism as claimed in claim 1, wherein the lock shell includes at least one mounting flange effective for friction-fit installation in a mounting bore.

11. A lock mechanism as claimed in claim 7, wherein said integral electrically conductive contact is S-shaped and is suited for low current operation.

12. A lock mechanism as claimed in claim 7, wherein said first and second electrically conductive terminals are disposed in diametrically opposed positions on said shell.

13. A lock mechanism as claimed in claim 12, wherein said integral electrically conductive contact is straight and of substantial thickness and is suited for high current operation.

14. A lock mechanism as claimed in claim 13, wherein said actuation receiving means includes a contact retaining extension with a radial slot which is adapted to receive said electrically conductive contact.

* * * * *

UNITED STATES PATENT AND TRADEMARK OFFICE

CERTIFICATE OF CORRECTION

PATENT NO. : 5,479,800

DATED : January 2, 1996

INVENTOR(S) : Myers

It is certified that error appears in the above-identified patent and that said Letters Patent is hereby corrected as shown below:

Col. 1, line 5, after "my" insert --copending --

Signed and Sealed this

Eighteenth Day of May, 1999

*Attest:*

*Attesting Officer*

Q. TODD DICKINSON

*Acting Commissioner of Patents and Trademarks*